US007086708B2

(12) United States Patent
Tseng et al.

(10) Patent No.: US 7,086,708 B2
(45) Date of Patent: Aug. 8, 2006

(54) BUFFER DEVICE FOR A SLIDE STRUCTURE

(75) Inventors: I-Ming Tseng, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaosiung Hsien (TW)

( * ) Notice: Subject to any disclaimer, the term of this patent is extended or adjusted under 35 U.S.C. 154(b) by 0 days.

(21) Appl. No.: 10/910,315

(22) Filed: Aug. 4, 2004

(65) Prior Publication Data

US 2006/0028104 A1 Feb. 9, 2006

(51) Int. Cl.
*A47B 88/04* (2006.01)

(52) U.S. Cl. ..... 312/334.44; 312/334.1

(58) Field of Classification Search ..... 312/334.1, 312/334.7, 334.8, 334.11, 334.16, 334.22, 312/330.1, 333, 334.44, 334.46; 384/18, 384/20, 21

See application file for complete search history.

(56) References Cited

U.S. PATENT DOCUMENTS

| | | | | |
|---|---|---|---|---|
| 4,370,007 | A * | 1/1983 | Fler | 312/334.11 |
| 4,423,914 | A * | 1/1984 | Vander Ley | 312/333 |
| 4,469,384 | A * | 9/1984 | Fler et al. | 312/333 |
| 4,932,792 | A * | 6/1990 | Baxter | 384/18 |
| 5,507,571 | A * | 4/1996 | Hoffman | 312/334.8 |
| 6,145,944 | A * | 11/2000 | Bayani et al. | 312/334.44 |
| 6,244,678 | B1 * | 6/2001 | Dopp et al. | 312/333 |
| 6,254,209 | B1 | 7/2001 | Parvin | |
| 6,367,899 | B1 * | 4/2002 | Hwang et al. | 312/334.47 |

FOREIGN PATENT DOCUMENTS

| | | | | |
|---|---|---|---|---|
| DE | 2707365 | * | 8/1978 | 312/334.44 |

* cited by examiner

*Primary Examiner*—James O. Hansen
(74) *Attorney, Agent, or Firm*—Rosenberg, Klein & Lee

(57) ABSTRACT

A buffer device for a slide structure includes a buffer secured to the rear end of a fixed track to provide a buffer effect. The buffer provides a steady elastic force when in contact with a mobile track to maintain a steady and stable status. The buffer comprises a slot at the center portion to be sleeved onto a plate extending from the rear end of the fixed track to provide an elastic force when striking by the mobile track.

4 Claims, 4 Drawing Sheets

BUFFER DEVICE FOR A SLIDE STRUCTURE

BACKGROUND OF THE INVENTION

1. Field of the Invention

This invention relates to a buffer device for a slide structure, and more particularly to a track with a buffer device installed to the rear end of a fixed track to release the striking force from a mobile track against the fixed track.

2. Description of the Prior Art

Slides have been widely used by users. A conventional slide includes a fixed track, a middle track and a mobile track. Taking the slide adapted to a cabinet and its drawers for example, the fixed track is secured to each inner side of the closet, while the mobile track is secured to each side of the drawer. The middle track is secured to the fixed track through ball bearings in a slidable manner to carry the mobile track. As shown in FIG. 8, a prior art comprises a mobile track A, a middle track B and a fixed track C. The mobile track A and the middle track B are connected with an axially sliding part D. The middle track B and the fixed track C are connected with an axially sliding part E. The mobile track A has a stopper F which corresponds with a block G of the middle track B allowing the mobile track A to stop at a fixed place. The rear end of the mobile track A has a reduced opening A1. The front end of the mobile track A has a bending plate A2. A buffer block H is formed at the rear end of the fixed track C.

The stopper F has a protuberance F1. The block G has a block plate G1 which secures with the protuberance F1 of the stopper F when the mobile track A is moving forward to prevent detachment.

Further, when the mobile track A is pushed inward, the bending plate A2 undertakes the striking force from the block G of the middle track B until the mobile track A reaches to the fixed track C, while the reduced opening A1 will engage with the buffer block H in a secured status.

The buffer block H has been revealed by a prior art, please refer to a U.S. Pat. No. 6,254,209, which secures the buffer block to an upright raised plate at the rear end of the fixed track. After studying the design of the buffer block secured to the rear end of the fixed tracks, another shortcomings were disclosed, please refer to the cross-section view of FIG. 9 of the U.S. patent. The shortcomings are:

1. The center portion of the through of the buffer block bulges out a portion, which causes the two ends of the buffer block in a different width, which is to be contacted with the rear end of the mobile track to produce an elastic pressure force to buffer the striking force. However, due to the differential between the widths, the elastic deformation degree is different, plus the engagement point of the rear end of the mobile track varies depending upon the material. Some materials are tightening and some are loosening, it is hard to control all materials to have the same tightness effect.
2. The two bulged portions of the buffer block are also designed to have different widths at the engaging area between the buffer block and the plate of the mobile track. This causes differential of the elastic pressure force, and is difficult to control or to measure the tightness.

This prior art causes different elastic effects and is hard to get a precise measurement.

SUMMARY OF THE INVENTION

It is the primary objective of the present invention to provide a buffer device for a slide structure, which is steady and secure.

It is another objective of the present invention to provide a buffer device for a slide structure, which can sustain the striking force.

It is a further objective of the present invention to provide a buffer device for a slide structure, which is more solid and reliable.

DETAILED DESCRIPTION OF THE PREFERRED EMBODIMENTS

Figure 1:
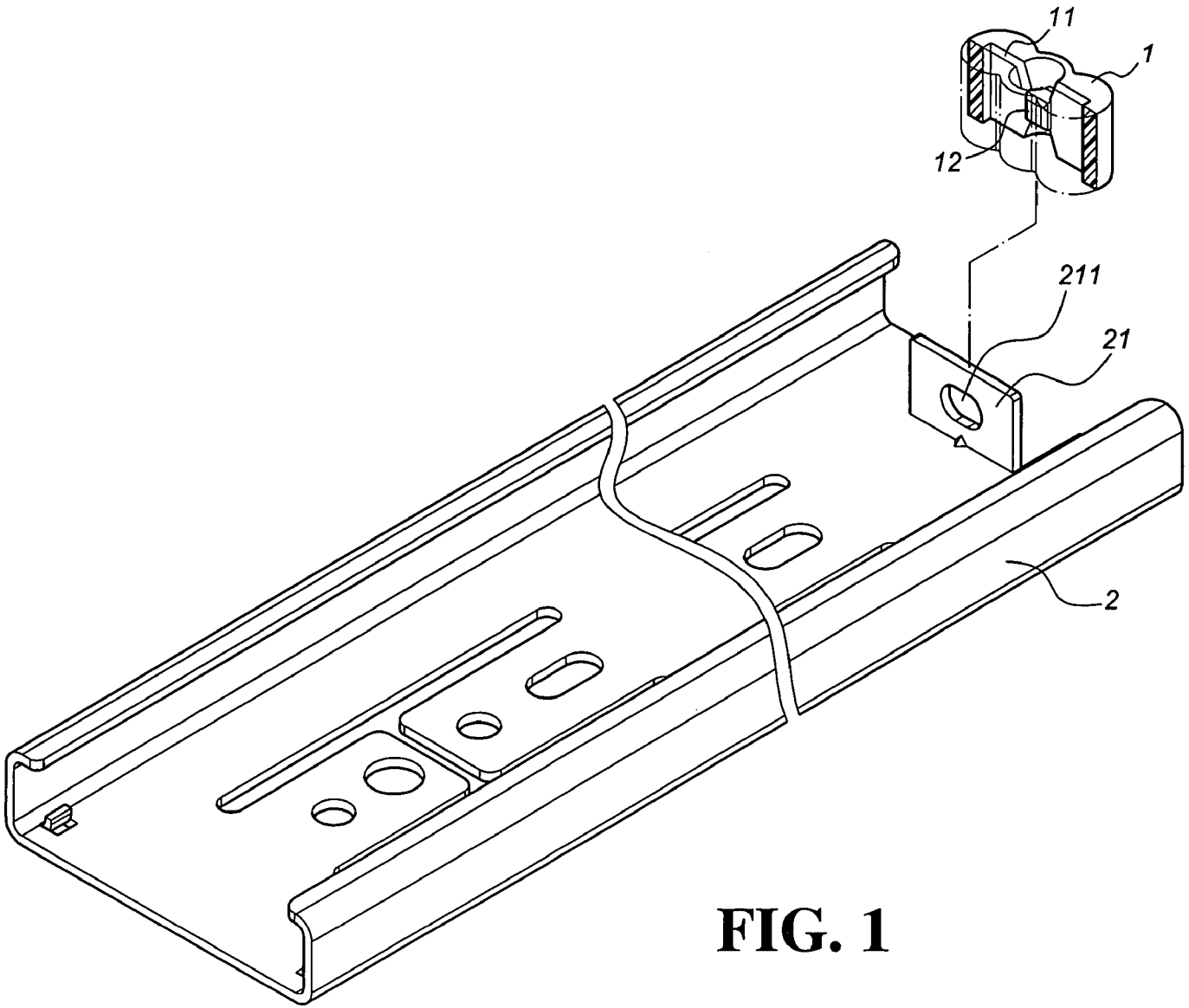
FIG. 1 is an exploded view of the present invention.

As shown in FIG. 1, a buffer device for a slide structure of the present invention comprises a buffer 1 secured to the rear end of a fixed track 2. The fixed track 2 has a plate 21 extending perpendicularly from the rear end for the buffer 1 to sleeve thereon.

The buffer 1 comprises a slot 11 having two flat ends. Two ends of the buffer 1 have the same width in cross-section. The buffer 1 further comprises a protuberance 12 protruding from an inner side at the center portion of the slot 11.

The plate 21 extending perpendicularly from the rear end of the fixed track 2 has two even sides and a hole 211 formed at the center for the protuberance 12 to insert therein.

Figure 2:
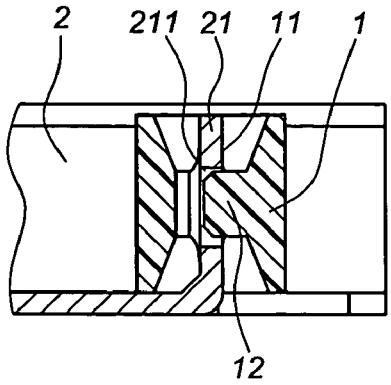
FIG. 2 is a cross-sectional view showing an assembly of the present invention.

To assemble the present invention, as shown in FIG. 2, the buffer 1 is deposed onto the plate 21 of the fixed track 2 through the slot 11 so that the two are evenly connected with the protuberance 12 inserting into the hole 211 of the plate 21. The buffer 1 has a steady elastic force at respective two ends from the top to the bottom. This provides a steady contact with the striking pressure applied.

The slot 11 of the buffer 1 may be smaller in size than that of the plate 21 in cross-section to provide a tight connection.

Figure 3:
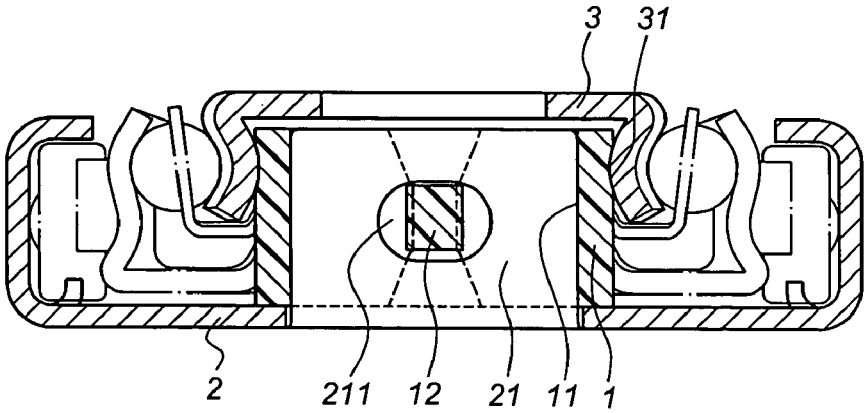
FIG. 3 is a cross-sectional view showing the present invention in an operation status.

As shown in FIG. 3, when a mobile track 3 reaches to the fixed track 2, a reduced opening 31 at the rear end of the mobile track 3 clips the buffer 1 of the fixed track 2. Because the buffer 1 provides a steady elastic force, it is advantageous to control the tightness of the positioning status even though the clipping position is varied.

Figure 4:
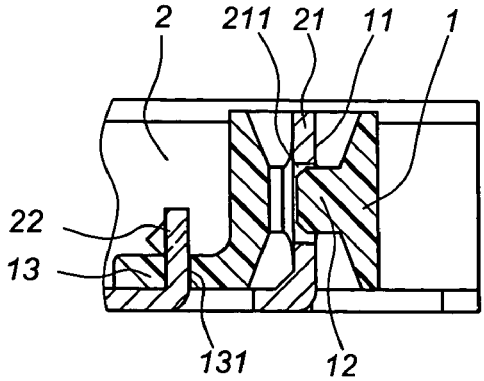
FIG. 4 is cross-sectional view showing a first embodiment of the present invention.

Furthermore, to secure the buffer 1 to the rear end of the fixed track 2 without affecting the stability of contact pressure of the mobile track 3 striking the buffer 1, the buffer 1 may extend a connecting section 13 from the front bottom edge with a hole 131 at the center for a protruding plate 22 of the fixed track 2 to extend there through without affecting the clipping area of the reduced opening 31 of the mobile track 3, as shown in FIG. 4.

Figure 5:
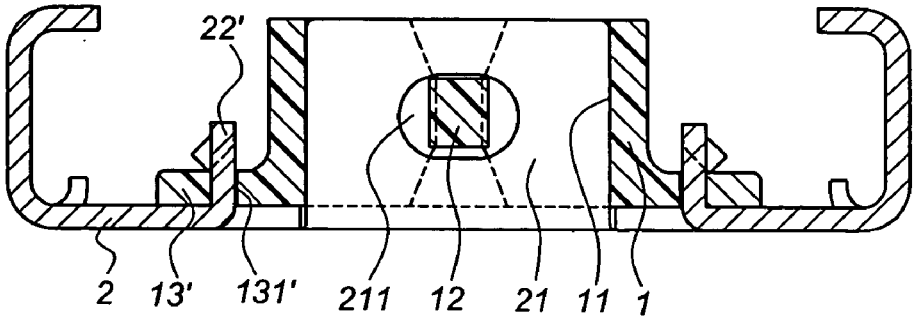
FIG. 5 is cross-sectional view showing a second embodiment of the present invention.
Figure 6:
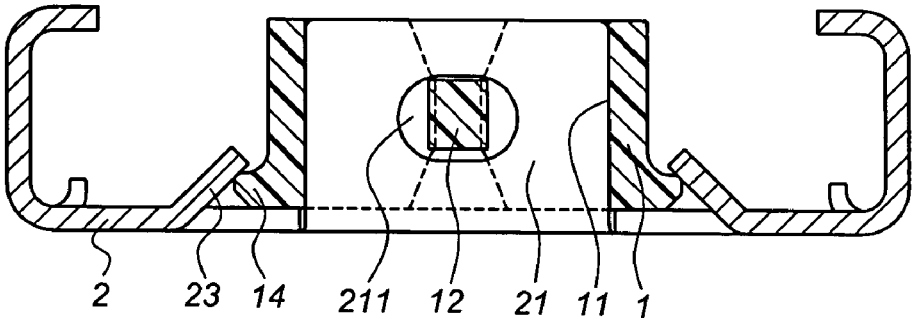
FIG. 6 is cross-sectional view showing a third embodiment of the present invention.

A connecting section 13' is each formed at two sides of the bottom of the buffer 1 with a hole 131' at the center thereof, as shown in FIG. 5, and a corresponding protruding plate 22' is each to be inserted into the hole 131', or a male hook 14 is each formed at two sides of the bottom of the buffer 1, while the fixed track 2 is formed with female hooks 23 to clip with the male hooks 14 of the buffer 1, as shown in FIG. 6.

Figure 7:
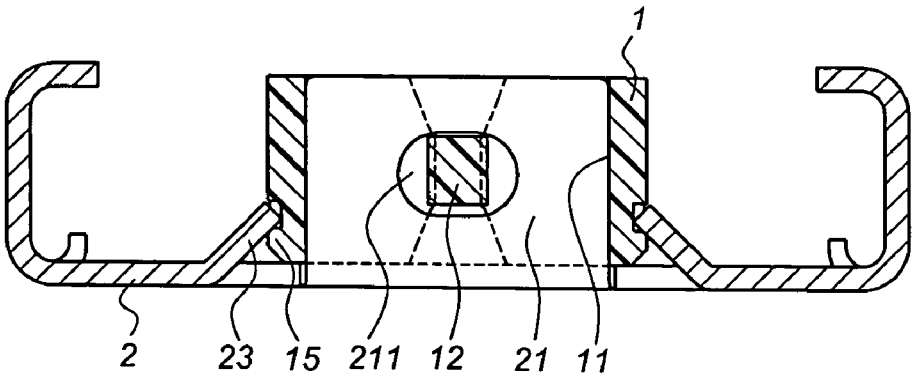
FIG. 7 is cross-sectional view showing a fourth embodiment of the present invention.
Figure 8:
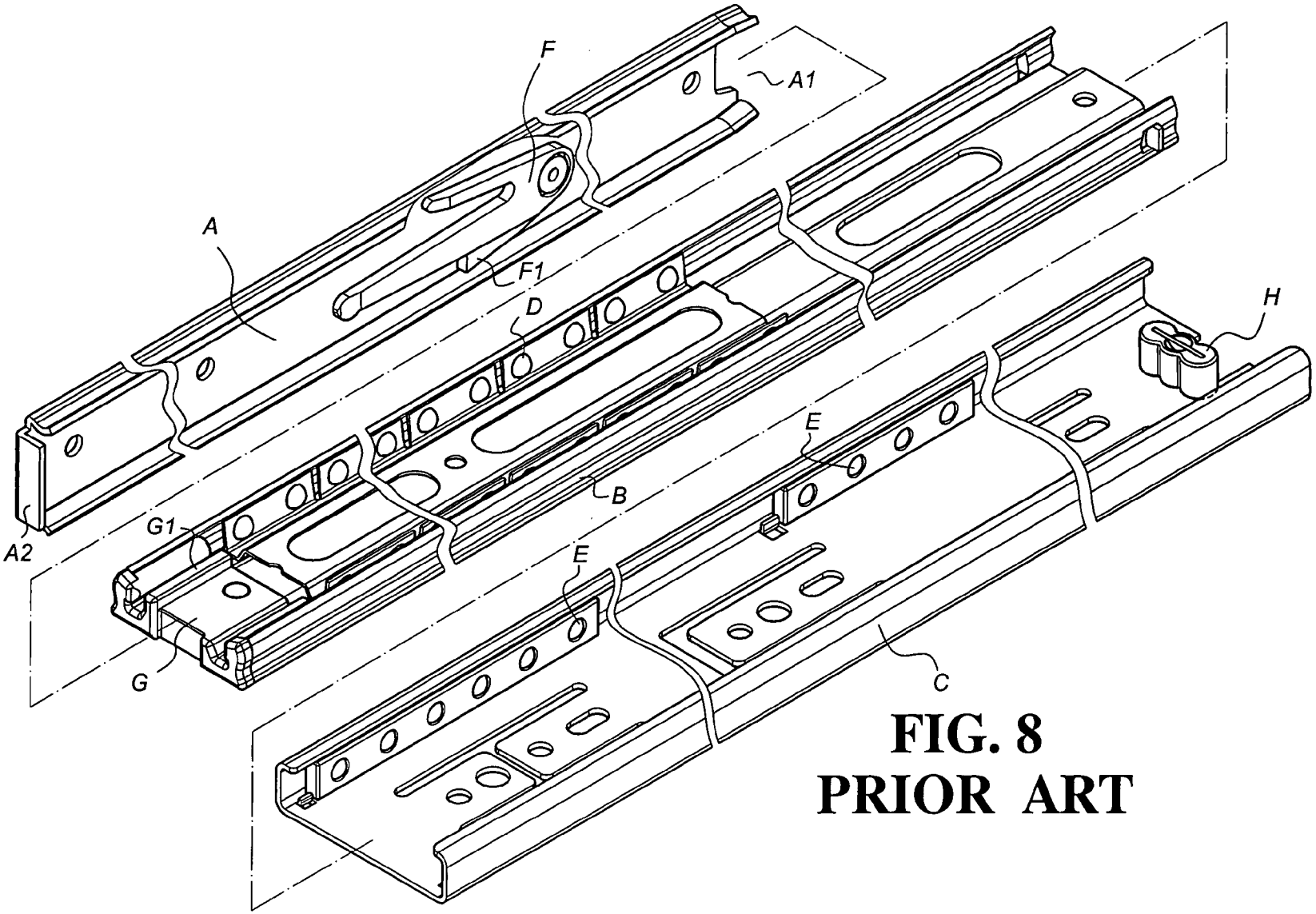
FIG. 8 PRIOR ART
FIG. 8 is an exploded view of a prior art.

In addition, as shown in FIG. 7, the buffer 1 may have a recess at each side of the bottom of the buffer 1 to form another hook 15, and the fixed track 2 is formed with hooks 23 protruding upwardly and corresponding to the recesses to engage with the hooks 15.

What is claimed is:

1. A buffer device for a slide structure comprising:

a buffer secured to a rear end of a fixed track to buffer striking force from a mobile track;

a pair of male hooks respectively extending from a bottom of opposing sides of said buffer; and a pair of female hooks being respectively formed adjacent said rear end of said fixed track on opposing sides thereof in correspondence with said male hooks for engagement therewith, said buffer including a slot having two flat ends and a protuberance, said two flat ends of said buffer having the same width in cross-section, said protuberance being coupled to said fixed track;

said fixed track comprising a plate having two even sides;

said buffer being disposed on said plate of said fixed track through said slot and providing equal elastic force at said respective two flat ends.

2. The buffer device for a slide structure, as recited in claim 1, wherein said slot of said buffer has a width slightly smaller than that of said plate of said fixed track in cross-section to provide a tight connection.

3. The buffer device for a slide structure, as recited in claim 1, wherein said plate of said fixed track comprises a hole at a center portion thereof for insertion of said protuberance protruding from an inner side of said slot of said buffer for securing purpose.

4. A buffer device for a slide structure comprising:

a buffer secured to a rear end of a fixed track to buffer striking force from a mobile track, said buffer having a recess being formed on each of a pair of opposing sides of said buffer to define a respective hook adjacent a bottom of each said side thereof;

said buffer including a slot having two flat ends and a protuberance, said two flat ends of said buffer having the same width in cross-section, said protuberance being coupled to said fixed track, said buffer being placed onto said plate of said fixed track through said slot thereby providing equal elastic force at said respective two flat ends; and said fixed track comprising a plate having two even sides and a pair of mating hooks formed adjacent said rear end thereof in correspondence with said hooks of said buffer for engagement therewith.

* * * * *